US011052973B1

(12) United States Patent
Rabaut et al.

(10) Patent No.: US 11,052,973 B1
(45) Date of Patent: Jul. 6, 2021

(54) FLOATABLE STRUCTURE COMPRISING A MOORING SYSTEM FOR MOORING A SECOND FLOATING STRUCTURE, AND METHOD FOR MOORING THE SECOND FLOATING STRUCTURE

(71) Applicant: DEME Offshore BE NV, Zwijndrecht (BE)

(72) Inventors: Dieter Wim Rabaut, Ghent (BE); Michiel Marius Bertels, Ulvenhout (NL)

(73) Assignee: DEME Offshore BE NV, Zwijndrecht (BE)

( * ) Notice: Subject to any disclaimer, the term of this patent is extended or adjusted under 35 U.S.C. 154(b) by 0 days.

(21) Appl. No.: 16/938,513

(22) Filed: Jul. 24, 2020

(51) Int. Cl.
*B63B 35/44* (2006.01)
*B63B 21/50* (2006.01)

(52) U.S. Cl.
CPC ..... *B63B 21/502* (2013.01); *B63B 35/44* (2013.01)

(58) Field of Classification Search
CPC ..... B63B 21/502; B63B 35/44; B63B 21/00; B63B 27/30
See application file for complete search history.

(56) References Cited

U.S. PATENT DOCUMENTS 3,986,741 A * 10/1976 Giovannini ..... E05C 19/003 292/268
5,154,561 A * 10/1992 Lee ..... B63B 27/12 114/264
9,512,678 B2 * 12/2016 Valsecchi ..... E21B 7/128
10,569,977 B1 * 2/2020 Hammer ..... B63B 27/10
2013/0291777 A1 * 11/2013 Borch-Jensen ..... B63B 39/00 114/230.1

* cited by examiner

*Primary Examiner* — Anthony D Wiest
(74) *Attorney, Agent, or Firm* — The Webb Law Firm

(57) ABSTRACT

A floatable structure is described having a hull and a deck. The floatable structure further includes a mooring system for mooring a second floating structure at a mooring position relative to the floatable structure. The mooring system brings the second floating structure down in the water from an initial floating draft to a larger mooring draft to reduce motions of the second floating structure relative to the floatable structure. A method for mooring a second floating structure using the mooring system is also described.

23 Claims, 12 Drawing Sheets

FLOATABLE STRUCTURE COMPRISING A MOORING SYSTEM FOR MOORING A SECOND FLOATING STRUCTURE, AND METHOD FOR MOORING THE SECOND FLOATING STRUCTURE

BACKGROUND OF THE INVENTION

Field of the Invention

The invention relates to a floatable structure comprising a mooring system and to a method for mooring a second floating structure against or under the floatable structure. The invention further relates to an assembly of a floatable structure and a second floating structure, moored relative to each other with the mooring system.

A particular embodiment relates to a floatable structure that comprises a jack-up platform, in particular in a jacked-up or semi jacked-up position. A particular embodiment of the second floating structure comprises a floating vessel or barge, moored against the jack-up platform.

The mooring system may be used for permanent mooring or for temporary mooring a second floating structure.

Description of Related Art

A floating structure such as a vessel in a water mass is subject to movements according to six degrees of freedom. Translational movements comprise heave, sway and surge. Where heave is a vertical movement, sway is the side to side or port to starboard movement and surge is the front to back or bow to stern movement. Rotational movements comprise pitch, roll and yaw. Where pitch is a rotation of a vessel about its lateral (port-starboard) axis, roll is the rotation about its longitudinal (bow-stern) axis, and yaw is the rotation about its vertical axis. Heave, sway, surge, pitch, roll and yaw movements are defined in a coordinate system fixed to the floating vessel and therefore may differ from movements in the vertical and two horizontal directions, defined by a coordinate system fixed to the outside world. Because the degrees of freedom do not only relate to displacement but also relate to speed (velocity) and acceleration, there are actually 18 motion parameters of interest.

The motions of the water mass are transferred to a vessel that is floating on the water mass. The induced vessel movements, in turn, impose movements and accelerations on objects that are transported by the vessel or manipulated on or from the vessel. When lifting an object from a deck of a floating vessel with a lifting device for instance, the relative position between the floating vessel, including the object to be lifted off, and the lifting device preferably should be kept fixed within certain horizontal distance limitations that are defined by the lifting device's specifications. The object preferably should be kept positioned within a watch circle of the lifting device to avoid lifting the object under an angle with the vertical direction that is too large for the lifting device to handle. Preferably, a hoisting wire of the lifting device is kept substantially vertical during the lifting operations. This is especially the case when the lifting device is not provided on the floating vessel itself, but is provided on another floating vessel and/or on a stabilized vessel or platform, such as a jack-up platform that is separate from the object's vessel.

When lifting off an object from the floating vessel with a lifting device located on a jack-up platform for instance, it is of importance that the horizontal position (⅔ translational degrees of freedom: surge & sway) and the horizontal rotational movement (⅓ rotational degrees of freedom: yaw) of the floating vessel, and therefore also of the objects it carries, remain fixed within certain limitations relative to the location of the lifting device, in order to avoid lifting device breakdown for instance during the lift, and to ensure a safe rigging procedure. The floating vessel preferably should have a fixed position versus the jack-up platform and the lifting device, provided thereon. Also, the jack-up platform and the lifting device preferably have to remain in a fixed horizontal position relative to an outside world reference system during lifting. Further, when using a lifting device provided on a semi-jacked-up or jacked-up jack-up platform, this lifting device will also be fixed horizontally relative to an outside world reference system during lifting. If both the floating vessel and lifting device are fixed horizontally to the same outside world reference system, their relative horizontal position will be also fixed towards each other. Further and ideally, the object to be lifted should preferably be positioned directly under the lifting device's connection point in a vertical direction. This is particularly challenging when lifting an object from a floating vessel carried out with a lifting device provided on a fixedly positioned jack-up vessel or platform in offshore conditions.

Known methods and systems for keeping a floating vessel positioned offshore next to another floatable structure such as a jack-up vessel or other vessel comprise anchoring systems in the first place. The floating vessel may then be equipped with an anchor spread. Usually an assist vessel (anchor handler) needs to be used in parallel, which is costly. Also, positioning a floating vessel on anchors is time consuming, and in fact reduces mainly horizontal motions, and not vertical motions. The assist vessel picks up the anchors from the floating vessel and positions these at the correct location on the seabed. Having a couple of anchors lines out in different directions will keep the floating vessel or barge positioned in a more or less stable position. Anchoring systems are not ideal when used in combination with a jack-up vessel or platform, in particular when it is the intention to position the floating vessel as close as possible to the jack-up vessel. Depending on the size of the jack-up vessel and the floating vessel, as well as on the relative position of both, anchor lines could clash with the legs of the jack-up vessel, which represents a large risk. If an anchor line breaks, the floating vessel's position can become uncontrollable and a clash may even occur between the floating vessel itself and the legs of the jack-up vessel or platform when the lifting is performed when the jack-up vessel or platform is jacked-up until a height where the floating vessel fits under the jack-up vessel or platform. Such clashing indeed may immediately compromise the integrity of the jack-up vessel or platform. Also, anchors are typically fixated in the seabed, which may cause interfacing with existing (buried) structures in the seabed, for instance, but not limited to cables, pipelines, other debris and such like. Preliminary surveys are needed.

Another known method and system employs a floating vessel equipped with a dynamic positioning (DP) system, which also requires a certain amount of thrusters capable of holding the floating vessel in a fixed position. As with anchoring systems, a DP system reduces mainly horizontal motions, and not vertical motions. The more power the DP system possesses, the more accurate it can keep a certain position up to a designed sea state. More power will however come with greater cost. The accuracy of positioning when lifting an object off a floating vessel using a lifting device fixed on a static jack-up platform further should preferably be high, which requires thrusters with a high power. Using a floating vessel equipped with a DP system in close proximity with another structure (for instance the elevated jack-up platform, an offshore foundation or other) may also involve risks. A DP system's power is continuously adjusting to cope with external forces (water, wind, other, . . . ). As the system is working close to a structure, its own thruster force may induce forces that come into contact with the fixed structure and are reflected from it. This could cause the DP system to assume that the structure is applying a direct force onto the floating vessel (even if a physical connection between the floating vessel and the jack-up vessel has not been made). As a reaction, the DP system could try to react against this 'fake' external force by activating more power in the direction of the structure. This could cause the DP system to actually move the floating vessel towards the structure, cause it to collide with the structure. This of course is highly undesirable.

Although the known systems may be used in some circumstances, they generally have disadvantages, as stated above. The capacity of the lifting device on a jack-up platform for instance may not be fully utilised since the floating vessel should in the known methods always leave some distance to (the legs of) the jack-up platform. Indeed, when the floating vessel would approach the (main legs of the) jack-up platform too closely, it could for instance partly slide under the jacked-up jack-up platform, hit the main legs and endanger the total stability of the jack-up platform.

SUMMARY OF THE INVENTION

The invention allows to effectively stabilizing a second floating structure when moored against, under or in the vicinity of the floatable structure. The floatable structure may also be referred to as a first floatable structure. The floatable structure is floatable in the sense that it may be floating (like the second floating structure) or that it may be brought in a non-floating state from a floating state, such as in the case of a jack-up platform for instance.

The invention may for instance be relevant in the context of lifting objects between a floating vessel (as second floating structure) and a jack-up platform, by using a lifting device positioned on the jack-up platform. The lifting may be carried out in waters on-shore or off-shore, the latter being preferred. The jack-up platform may be floating, may be in a semi-jacked-up position, in which its hull is still in the water, or may be jacked-up with its hull fully out of the water. The jack-up platform in the latter case represents a relatively stable position for the lifting device. The jack-up platform may be self-propelled in which case it is generally referred to as a jack-up vessel. It is expressly stated that when a jack-up platform is referred to throughout the present disclosure, reference is also made to a jack-up vessel.

The invention is not limited to the lifting of particular objects, but may be used with advantage for lifting turbine components, such as a full tower of for instance 900 tons, a split tower (two sections) of 500 tons each for instance, a split tower (three sections) of 350 tons each for instance, a nacelle (+ rotor) of 800 tons for instance, blades (or a blade rack carrying a single blade, or a complete blade rack carrying multiple blades), and a pre-assembled combination of the above in any form. It is also possible to use the invention for lifting wind turbine foundation components, such as a monopile of 1600 tons for instance, a transition piece of 500 tons for instance, an anode cage (or anode cage tower containing multiple anode cages), and complete jackets, weighing up to 1600 tons and more. Apart from the above named objects, general items may also be lifted with the lifting device when using the invented mooring system. Such general items include but are not limited to supply containers of any kind, offshore wind turbine (foundation) installation equipment, and spare vessel and equipment parts.

Other uses may be providing an offshore harbor for mooring second floating structures, such as vessels; using the stabilized moored second floating structures for offshore subsea cable supports; and many other applications in which a stably moored second floating structure may be of use. A further use for instance relates to providing a stabilized step-up platform (as second floating structure) for transfer of personnel or passengers to a floating structure, such as a jack-up platform or vessel, or a cruise ship.

The invention may be of value in the oil and gas industry, the offshore exploration industry, the offshore drilling industry, and in fact in any offshore industry where stabilized floatable structures are of advantage, such as in the tourist industry for instance.

It is an aim of the invention therefore to provide an adapted floating structure and method that makes it feasible to stabilize a second floating structure moored relative to the floating structure, where stabilization is effective in a horizontal direction, but also in a vertical direction.

With stabilization is meant that motions of the second floating structure relative to the floating structure and/or to the outside world reference system are reduced.

Provided for this and other purposes is a floating structure in accordance with claim 1. A floating structure is provided that comprises a hull provided with a deck and a mooring system attached to the floating structure and configured to moor a second floating structure at a mooring position relative to the floating structure, wherein the mooring system is configured to bring the second floating structure down in the water from an initial floating draft to a larger mooring draft to reduce motions of the second floating structure relative to the first floating structure, and optionally also relative to the world.

It has been established that even a relatively huge barge may be easily pulled down in the water to the mooring draft and reduce motions by as much as 85%. The mooring draft may be determined by one skilled in the art. An increased mooring draft will increase the stresses in the mooring system, and one skilled in the art will know how much stress can be carried by the mooring system, and how much mooring draft is needed for reducing motions to a desirable level. In the mooring position, the second floating structure is still floating at the mooring draft.

An embodiment of the invention provides a floating structure wherein the mooring system is configured to push the second floating structure down in the water from the floating draft to the larger mooring draft.

A practical embodiment of such a mooring system is provided by a floating structure wherein the mooring system configured to push the second floating structure down comprises a push-down support structure attached to the hull of the floating structure for pushing members that are at least movable in a vertical direction and contact a surface of the second floating structure to push it down.

Yet another even more practical embodiment provides a floating structure wherein the mooring system is configured to pull the second floating structure down in the water from the floating draft to the larger mooring draft.

A practical embodiment of such a mooring system provides a floating structure wherein the mooring system configured to pull the second floating structure down comprises a pull-down support structure attached to the hull of the floating structure and extending over some length into the water to a depth below the second floating structure, and at least one tension cable extending between the pull-down support structure and the second floating structure to be moored, preferably between the pull-down support structure and corners of the second floating structure to be moored.

The at least one tension cable is positioned such that it can pull down the second floating structure to the mooring draft. For instance, an attachment point of the at least one tension cable to the pull-down support structure is preferably positioned lower than an attachment of the at least one tension cable to the second floating structure.

The at least one tension cable is suitably attached to a bottom side of the second floating structure, but the attachment may also be positioned at another position of the second floating structure, such as at a hull or deck portion thereof.

Although the number and size of the second floating structure(s) may be varied, at least the size of the second floating structure is smaller than the floating structure in an embodiment of the invention.

In another embodiment of the invention, a floating structure is provided wherein the mooring position is underneath the floating structure. In this embodiment, a second floating structure moored underneath the floating structure may be carried along with the sailing floating structure. In an embodiment wherein the floating structure comprises a jack-up platform and the mooring position is underneath the jack-up platform, it is understood that the jack-up platform is preferably in its jacked-up state or in a semi-jacked-up state where the hull is still floating on the water.

In another embodiment, the mooring position is along a side of the floating structure.

A practical embodiment of the invention relates to a floating structure wherein the mooring system comprises the pull-down support structure, and the at least one tension cable extends between the second floating structure to be moored to a sheave provided at a lower part of the pull-down support structure and from there to a winch provided at a higher part of the pull-down support structure. In other embodiments, the at least one tension cable may be attached to the pull-down support structure and then extend to a winch, provided on the second floating structure. The second floating structure in this embodiment is then able to pull itself down.

The higher part may be located anywhere, as long as it is higher than the lower part. In an embodiment, the higher part of the pull-down support structure is located above the water line.

Yet another embodiment of the invention provides a floating structure wherein the mooring system comprises the push-down and/or pull-down support structure and at least one of said support structures is formed by at least one elongated support member attached to a side of the floating structure and extending over some length into the water to a depth below the second floating structure. The at least one elongated support member preferably extends vertically, and the number of elongated support members is preferably at least two, and more preferably at least three.

The elongated support members of the mooring system may be embodied in many shapes. It may be shaped as a wall, or it may be shaped otherwise. A practical embodiment of the elongated support member comprises a leg, optionally of similar construction as the legs of the jack-up platform. The elongated support members may comprise a full steel structure of any cross-sectional shape, or may comprise a lattice structure of any cross-sectional shape, for instance having a triangular or square cross-section. The elongated support members are elongated in the sense that they are configured to be provided in the water mass over a distance that may cover a substantial water depth, such as more than 50% of the water depth at the offshore mooring location, more preferably more than 60%, more preferably more than 70%, even more preferably more than 80%, or more than 90%, and even more preferably up to 100% of the water depth, being the distance from the water line to the sea bed. In a mooring positon of a second floating structure or vessel, said second floating vessel may be able to contact the elongated support members in the moored state but this is not necessary.

The elongated support members may be attached to the hull of the floating structure in a number of ways. In a preferred embodiment, the floating structure further comprising guiding means connected to the hull of the floating structure at the mooring position, and configured to rigidly hold an elongated support member in a support position, in which the elongated support means is within reach of a part of the second floating structure.

The guiding means may for instance be welded to a side of the hull of the floating structure, or they may be connected to a part of the floating structure in any other suitable way.

The guiding means may be embodiment in many different ways, as long as they are configured to hold the elongated support members in a support position, in which the elongated support members may be within reach of a hull part of the second floating structure. Suitable embodiments of the guiding means comprise circumferential bodies into which an elongated support member may be guided or slid, a ladder system onto which an elongated support member may be guided or slid, a pile-shaped body over which an elongated support member may be guided or slid, and the like. One skilled in the art will be able to design several embodiments of such guiding means without any difficulty.

Preferably, the guiding means are hingedly connected to the hull of the floating structure so that the inclination of the elongated support member(s) may be varied in a vertical plane, either parallel or perpendicular to said side of the floating structure.

In another embodiment, the guiding means are configured to hold the elongated support member and move the same between different vertical positions, preferably by comprising a jacking system.

In a mechanically improved embodiment, the at least one elongated support member takes support on or in the underwater bottom. In other embodiments, they extend into the water up to a depth above the underwater bottom.

The mooring system may be portable in the sense that it may be provided separately from the floating structure, and connected to any type of floating structure or vessel, either permanently or temporarily.

In another embodiment of the invention, the floating structure comprises a jack-up platform comprising a number of vertical legs that connect to a working deck through jacking systems, each jacking system being configured to move a leg between a lower position, in which the leg takes support on an underwater bottom and the hull is jacked-up out of the water, and a higher position, in which the leg is free from the underwater bottom and the hull is floating on the water, wherein the mooring system comprises one or more legs of the jack-up platform, preferably at least two legs, and more preferably all legs.

In an embodiment wherein the mooring system comprises the push-down and/or pull-down support structure, at least one of said support structures is formed by one or more legs of the jack-up platform. In another embodiment, at least one of said support structures is formed by elongated support members, provided to a side of the jack-up platform, separate from the legs.

An embodiment of the invention provides a jack-up platform wherein the mooring system comprises a tension cable for each of the legs of the jack-up platform. Tension forces may then be distributed over all legs of the jack-up platform, if desired.

The legs of the jack-up platform may be positioned in their higher position or, alternatively, in the lower position.

Another embodiment provides a jack-up platform wherein the mooring position is along a side of the jack-up platform between two legs, and the mooring system comprises a tension cable for each of said legs. Such an embodiment would typically be provided when goods need to be transferred between the second floating structure and the jack-up platform, or when an object needs to be lifted from the second floating structure to the jack-up platform or to another structure already present on the seabed.

In order to be able to stably pull the object down in the water, a jack-up platform according to an embodiment is characterized in that the at least one tension cable extends between the leg of the jack-up platform and corners of the second floating structure.

The tension cable or cables may be provided between the second floating structure and the jack-up platform in a number of ways. In one embodiment, a jack-up platform is provided wherein the at least one tension cable extends between the second floating structure to be moored to a sheave provided at a lower part of the leg of the jack-up platform and from there to a winch provided at a higher part of the leg. This embodiment predominantly loads the legs instead of loading the jacking systems of the legs. It keeps the majority of the substantially vertical forces inside the legs.

A preferred embodiment provides a jack-up platform wherein the lower part of the leg comprises a transversely enlarged foot support of the leg. In this embodiment, the sheaves, or equivalent elements, are provided on the foot sections of the legs. In other embodiments, they may be provided on a side surface of the legs.

The legs are generally quite long, relative to the dimensions of the second floating structure. This means that the at least one tension cable will extend substantially vertical, which is preferred. In order to align the at least one tension cable still further along a vertical direction, a jack-up platform according to a preferred embodiment is provided with transversely enlarged foot supports that are extendable in the transverse direction, which extension is provided with the sheave. The extensions may for instance be embodied as a pivotable frame that may be folded out.

In another useful embodiment of the invented jack-up platform, the higher part of the leg is below the jacking system of the leg and optionally above the water line. This will prevent too large substantially vertical forces from developing in the jacking system.

When mooring a second floating structure with the invented jack-up platform, vertical forces are absorbed by the tension cable(s) and effectively reduce motions of the second floating structure relative to the jack-up platform. When the tension cable(s) do not extend in a perfectly vertical direction but deviate somewhat from this direction, horizontal forces will also be incurred, although at a lower level than the vertical (pull down) forces. Horizontal forces may also be reduced by the fact that the invented mooring system reduces the vertical motions.

The invention enables a second floating structure to be stabilized in a moored position, in a vertical and a horizontal plane, relative to the floating structure, such as a jack-up platform, for instance in jacked-up position.

When a jack-up vessel is preloaded and jacked-up to a certain working height above the waterline, a direct mooring of a second floating vessel, such as a barge, against the jack-up vessel would be nearly impossible. As the height of the hull of the jack-up platform is partly or completely raised out of the water and the floating body, of which the hull is partly submerged and partly above the water line, both hulls cannot be directly connected to each other using fenders in between. The jack-up platform comprising the invented mooring system solves this problem.

The invented mooring system provided on a jack-up platform in an embodiment enables limiting movements of the second floating vessel in a horizontal and vertical plane relative to the fixedly positioned jack-up platform, and therefore also to a lifting device (and hook), provided on the jack-up vessel or platform. The movements are limited by the invention such that they are mitigated more than sufficiently for offshore lifting, transfer of objects and components, and other purposes. During a lifting operation, heave movements are also limited to such extend as to avoid a re-hit of the object with the floating vessel in a first phase of lifting.

The invention has been created to safely position a second floating vessel in a water mass next to a floating structure such as a jacked-up jack-up vessel, whereby the second floating vessel is effectively stabilized with respect to surge, sway, and yaw movements, as well as roll and pitch movements. More specifically, the present invention may be used to safely lift objects from a floating vessel without having a side-off-lead angle that is too large for the lifting device to handle.

The mooring system may accommodate second floating vessels of different sizes. An embodiment which is particularly advantageous in this respect provides a jack-up platform wherein the guiding means are configured to hold the elongated support means and move the same between different vertical positions, preferably by comprising jacks. The guiding means are configured in this embodiment to guide the elongated support structure during its movement between different vertical positions, and to lock the elongated support structure in each desirable vertical position. A mechanical, hydraulic, or electric system, or a combination of such systems or other, could be incorporated in the guiding means to enable the (automatic) lowering, hoisting, and/or locking of the elongated support means at the different vertical (or height) positions.

According to the invention, the elongated support members is held in a support position, in which the elongated support members is within reach of the hull part of the second floating structure or vessel. The length of the elongated support members preferably is selected such that a minimum length of the elongated support members is able to cover the length between the top of the guiding means and a bottom of the second floating vessel's hull More preferably, an additional safety length may be taken into account.

Another useful embodiment of the invention provides a jack-up platform wherein the elongated support members, in the support position, takes support on or in the underwater bottom. In this embodiment, the elongated support members are as long, or may be longer than the length of the legs of the jack-up platform. Similar to the legs of the jack-up platform, a lower part of the elongated support members may be pinned into the seabed, so that parts of the horizontal loads, acting from the floating vessel onto the jack-up vessel, are transmitted directly into the seabed and only another part of these loads will be transmitted into the jack-up vessel itself. In this embodiment, less horizontal forces are absorbed through the jacking system (the jacks) of the jack-up platform, which jacking system is mainly designed to cope with vertical forces instead of horizontal forces. This embodiment may be engineered in detail, based on a site specific assessment, because the soil properties of the sea bed or other water floor, may differ on each offshore location. The horizontal forces that the jack-up platform may be able to absorb, may depend on the jacking capabilities and therefore on soil properties. On each different location the contribution and capabilities of the forces going directly into the seabed through the elongated support means are generally soil dependent and unpredictable, so should be engineered for each location separately. An embodiment wherein part of the forces are redirected directly into the soil of the seabed through the elongated support system is beneficial to the invention since horizontal forces acting on the jacking system of the jack-up vessel are reduced as much as possible.

Another useful embodiment of the invention provides a jack-up platform wherein a vertical leg of the jack-up platform comprises a transversely enlarged foot support and an elongated support means, in the support position, takes support on or in the transversely enlarged foot support. A transversely enlarged foot support is also referred to in the art as a footing, shoe or spud can. Instead of pinning the elongated support means into the soil of the seabed, the elongated support means in this embodiment are connected, optionally as well, to the spud cans or shoes of the legs of the jack-up vessel. These shoes or spud cans are located at a bottom side of the jack-up platform's legs. In this embodiment, part of the horizontally induced loads in the elongated support means may be transmitted directly to the bottom part of the jack-up platform's legs, which comprises the spud cans or shoes that are fixed onto or into the soil of the seabed. The part of the horizontal loads transmitted through the jack-up vessel's hull and the actual jacking system, and the part that is redirected directly through the elongated support means into the footings of the jack-up vessel may be calculated on the basis of knowledge of the length of the elongated support members extending below the hull of the jack-up vessel, and of the relative connection height of the floating vessel. This embodiment reduces the horizontal forces that are absorbed by the jacking system of the jack-up vessel, and further is independent on uncertainty related to soil conditions of the seabed.

Another embodiment provides a jack-up platform that further comprises a connecting structure configured to connect an elongated support members with a vertical leg of the jack-up platform, while allowing the elongated support members to be moved between different vertical positions. This embodiment allows to transferring some of the horizontal forces experienced by the elongated support means to the legs of the jack-up platform.

Although the elongated support means of the invented mooring system may in embodiments extend under a non-zero angle with the vertical direction, a useful embodiment of the invention provides a jack-up platform wherein the elongated support members extend vertically in the support position.

Resulting from the definition of a jack-up vessel or platform, the only part of the jack-up platform in jacked-up state that is situated on the same vertical level as the floating vessel comprise the legs of the jack-up vessel that indeed connect the elevated hull structure of the jack-up platform with the sea floor. It could be conceivable that a floating vessel could be tied up directly to the jack-up platform legs. However, these legs are designed to mainly cope with vertical forces and less with horizontal forces that may be induced by the moored floating vessel. An impact of a floating vessel against the jack-up platform legs could be catastrophic for the stability of the jack-up platform. Also, due to the more inward position of these legs relative to the working deck of the jack-up platform and the side of the hull thereof, tying up the floating vessel directly to the jack-up platform's legs may imply that the hull of the floating vessel will be positioned partly underneath the hull of the jack-up vessel or platform. In this way, valuable deck space on the floating vessel is lost. An embodiment of the invention provides a jack-up platform wherein the guiding means comprise a vertical leg of the jack-up platform, preferably two legs of the jack-up platform located at the mooring side. The elongated support members provides the desired space between the jack-up platform's and the floating vessel's hull and its legs, yet this embodiment may in some cases provide a useful and cost-effective solution to the problem. The elongated support members in this embodiment may be provided between two legs of the jack-up platform and be guided by these two legs. In another embodiment, each leg guides one elongated support members.

The number of elongated support members may be chosen according to the requirements of the circumstances at the offshore location. An embodiment of the jack-up platform wherein the number of elongated support members is at least two, and preferably at least three, s preferred. The plurality of the elongated support members may be provided along a line that optionally extends parallel to the mooring side of the hull of the jack-up platform.

Another aspect of the invention relates to an assembly of a jack-up platform comprising the invented mooring system and a second floating structure, moored against it with the mooring system.

Another aspect of the invention indeed relates to a method for mooring a second floating structure at a mooring position relative to a floating structure, as described in the present disclosure, the method comprising the step of bringing the second floating structure down in the water with the mooring system of the floating structure from an initial floating draft to a larger mooring draft to reduce motions of the second floating structure relative to the first floating structure.

An embodiment provides a method wherein the mooring system pushes the second floating structure down in the water from the floating draft to the larger mooring draft.

In such a method, the mooring system preferably pushes the second floating structure down by contacting a surface of the second floating structure with pushing members and moving the pushing members down in a vertical direction.

Another embodiment provides a method wherein the mooring system pulls the second floating structure down in the water from the floating draft to the larger mooring draft.

In such a method, the mooring system preferably pulls the second floating structure down by tensioning at least one tension cable that extends between a pull-down support structure extending over some length into the water to a depth below the second floating structure and attached to the hull of the floating structure, and the second floating structure to be moored.

The method is preferably carried out when the second floating structure is smaller than the floating structure.

In another embodiment of the method, the floating structure comprises a jack-up platform and the method comprises the steps of:

moving the legs of the jack-up platform from a higher position, in which the legs are free from an underwater bottom and the hull is floating on the water, to a lower position, in which the legs take support on the underwater bottom and the hull is jacked-up out of the water;

providing at least one tension cable that extends between a leg of the jack-up platform in the jacked-up state and the second floating structure to be moored, and pulling the second floating structure down in the water from a floating draft to a larger mooring draft by making use of said leg; and mooring the second floating structure against the jack-up platform.

In an alternative embodiment of the invention, a method is provided wherein the mooring system comprises the push-down and/or pull-down support structure and the support structure is formed by the at least one elongated support member attached to the side of the floating structure, and wherein the method further comprises providing at least one tension cable that extends between the at least one elongated support member and the second floating structure to be moored, and pulling the second floating structure down in the water from a floating draft to a larger mooring draft by making use of said support member; and mooring the second floating structure against the at least one elongated support member.

A purpose of the invention is to assist in transferring goods or people from the second floating structure to the floating structure and vice versa. Another purpose is in lifting an object from the moored second floating vessel that itself may lack a lifting device suitable for lifting the object, by employing a lifting device provided on the floating structure, such as embodied by a jack-up platform or vessel, against which the second floating vessel is moored. After having lifted the object off the floating vessel, the object may be placed directly onto or into an underwater bottom. It may however also be placed on deck of the floating vessel itself, the vessel or platform holding the lifting device, or it may be placed on deck of yet another supporting platform within lifting device reach, which may be the deck of another floating or jack-up vessel or platform. Another possibility is to place the object on top of a pre-installed wind turbine generator (WTG) part, or on a quay wall, jetty, oil rig platform, and the like.

It is expressly stated that the embodiments of the invention described in the present patent application can be combined in any possible combination of these embodiments, and that each embodiment can individually form the subject-matter of a divisional patent application.

Further embodiments or aspects are set forth in the following numbered clauses:

1. A floatable structure comprising a hull provided with a deck and a mooring system attached to the floatable structure and configured to moor a second floating structure at a mooring position relative to the floatable structure, wherein the mooring system is configured to bring the second floating structure down in the water from an initial floating draft to a larger mooring draft to reduce motions of the second floating structure relative to the first floatable structure.

2. The floatable structure according to clause 1, wherein the mooring system is configured to push the second floating structure down in the water from the floating draft to the larger mooring draft.

3. The floatable structure according to clause 2, wherein the mooring system configured to push the second floating structure down comprises a push-down support structure attached to the hull of the floatable structure for pushing members that are at least movable in a vertical direction and contact a surface of the second floating structure to push it down.

4. The floatable structure according to clause 1, wherein the mooring system is configured to pull the second floating structure down in the water from the floating draft to the larger mooring draft.

5. The floatable structure according to clause 4, wherein the mooring system configured to pull the second floating structure down comprises a pull-down support structure attached to the hull of the floatable structure and extending over some length into the water to a depth below the second floating structure, and at least one tension cable extending between the pull-down support structure and the second floating structure to be moored, preferably between the pull-down support structure and corners of the second floating structure to be moored.

6. The floatable structure according to any one of the preceding clauses, wherein the second floating structure is smaller than the floatable structure.

7. The floatable structure according to any one of the preceding clauses, wherein the mooring position is underneath the floatable structure.

8. The floatable structure according to any one of the preceding clauses, wherein the mooring position is along a side of the floatable structure.

9. The floatable structure according to any one of the preceding clauses, wherein the mooring system comprises the pull-down support structure and the at least one tension cable extends between the second floating structure to be moored to a sheave provided at a lower part of the pull-down support structure and from there to a winch provided at a higher part of the pull-down support structure.

10. The floatable structure according to any one of the preceding clauses, wherein the higher part of the pull-down support structure is above the water line.

11. The floatable structure according to any one of the preceding clauses, wherein the mooring system comprises the push-down and/or pull-down support structure and the support structure is formed by at least one elongated support member attached to a side of the floatable structure and extending over some length into the water to a depth below the second floating structure, wherein the at least one elongated support member preferably extends vertically, and the number of elongated support members is at least two, and more preferably at least three.

12. The floatable structure according to clause 11, further comprising guiding means connected to the hull of the floatable structure at the mooring position, and configured to rigidly hold an elongated support member in a support position, in which the elongated support means is within reach of a part of the second floating structure.

13. The floatable structure according to clause 12, wherein the guiding means are hingedly connected to the hull of the floatable structure.

14. The floatable structure according to any one of clauses 12-13, wherein the guiding means are configured to hold the elongated support member and move the same between different vertical positions, preferably by comprising a jacking system.

15. The floatable structure according to any one of clauses 11-14, wherein the at least one elongated support member takes support on or in the underwater bottom.

16. The floatable structure according to any one of the preceding clauses, wherein the floatable structure comprises a jack-up platform comprising a number of vertical legs that connect to a working deck through jacking systems, each jacking system being configured to move a leg between a lower position, in which the leg takes support on an underwater bottom and the hull is jacked-up out of the water, and a higher position, in which the leg is free from the underwater bottom and the hull is floating on the water, wherein the mooring system comprises one or more legs of the jack-up platform, preferably at least two legs, and more preferably all legs.

17. The floatable structure according to clauses 16, wherein the mooring system comprises the push-down and/or pull-down support structure and said support structure is formed by one or more legs of the jack-up platform.

18. The floatable structure according to clauses 16 or 17, wherein the legs of the jack-up platform are in the lower position.

19. The floatable structure according to any one of clauses 16-19, wherein the mooring position is along a side of the jack-up platform between two legs, and the mooring system comprises a tension cable for each of said legs.

20. The floatable structure according to any one of clauses 16-19, wherein the lower part of the leg comprises a transversely enlarged foot support of the leg.

21. The floatable structure according to clause 20, wherein the transversely enlarged foot support is extendable in the transverse direction, which extension is provided with the sheave.

22. The floatable structure according to any one of clauses 16-21, wherein the higher part of the leg is below the jacking system of the leg and optionally above the water line.

23. An assembly of a floatable structure in accordance with any one of the preceding clauses and a second floating structure, preferably a floating vessel, moored against it with the mooring system.

24. A method for mooring a second floating structure at a mooring position relative to a floatable structure in accordance with any one of the preceding clauses 1-23, the method comprising the step of bringing the second floating structure down in the water with the mooring system of the floatable structure from an initial floating draft to a larger mooring draft to reduce motions of the second floating structure relative to the floatable structure.

25. The method according to clause 24, wherein the mooring system pushes the second floating structure down in the water from the floating draft to the larger mooring draft.

26. The method according to clause 24, wherein the mooring system pushes the second floating structure down by contacting a surface of the second floating structure with pushing members and moving the pushing members down in a vertical direction.

27. The method according to clause 25, wherein the mooring system pulls the second floating structure down in the water from the floating draft to the larger mooring draft.

28. The method according to clause 27, wherein the mooring system pulls the second floating structure down by tensioning at least one tension cable that extends between a pull-down support structure extending over some length into the water to a depth below the second floating structure and attached to the hull of the floatable structure, and the second floating structure to be moored.

29. The method according to any one of clauses 24-28, wherein the second floating structure is smaller than the floatable structure.

30. The method according to any one of clauses 24-29, wherein the floatable structure comprises a jack-up platform, the method comprising the steps of:

moving the legs of the jack-up platform from a higher position, in which the legs are free from an underwater bottom and the hull is floating on the water, to a lower position, in which the legs take support on the underwater bottom and the hull is jacked-up out of the water;

providing at least one tension cable that extends between a leg of the jack-up platform in the jacked-up state and the second floating structure to be moored, and pulling the second floating structure down in the water from a floating draft to a larger mooring draft by making use of said leg; and mooring the second floating structure against the jack-up platform.

31. The method according to any one of clauses 24-29, wherein the mooring system comprises the push-down and/or pull-down support structure and the support structure is formed by the at least one elongated support member attached to the side of the floatable structure, the method further comprising providing at least one tension cable that extends between the at least one elongated support member and the second floating structure to be moored, and pulling the second floating structure down in the water from a floating draft to a larger mooring draft by making use of said support member; and mooring the second floating structure against the at least one elongated support member.

BRIEF DESCRIPTION OF THE DRAWINGS

The invention will now be elucidated with reference to the following figures, without however being limited thereto. In the figures.

DESCRIPTION OF THE INVENTION

Figure 11:
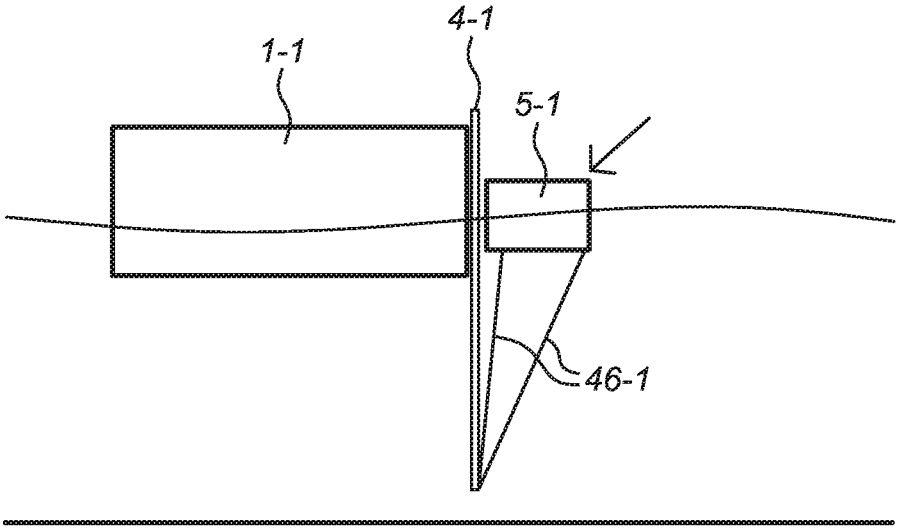
FIG. 11 shows a schematic side view of a mono-hull floating structure comprising a pull-down support structure according to an embodiment of the invention.

With reference to FIG. 11, a schematic side view of a mono-hull floating structure 1-1 is shown, illustrating the principle idea of the invention. The mono-hull floating structure 1-1 comprising a pull-down support structure 4-1 which may be embodied as one or more elongated support members that extend into the water to a depth below the bottom of a second floating structure 5-1 to be stably moored. Tension cables 46-1 extend from a lower position of the pull-down support structure 4-1 towards corner parts of the second floating structure 5-1. The tension cables 46-1 are tensioned, for instance by winches (not shown) provided on the pull-down support structure 4-1 and/or on the floating structure 5-1, which brings the second floating structure 5-1 from a floating draft to an increased mooring draft, as shown in FIG. 11. This effectively stabilizes the floating structure 5-1 with respect to horizontal and vertical motions.

Figure 12:
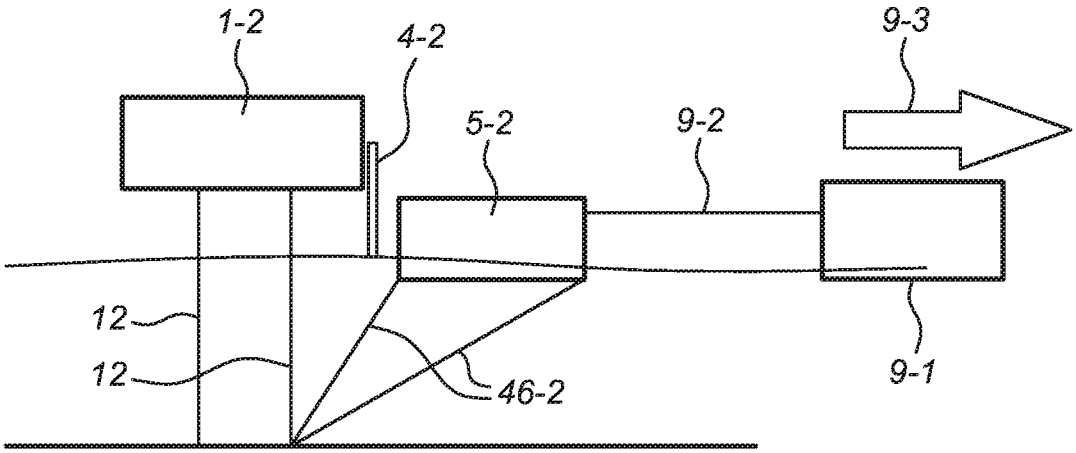
FIG. 12 shows a schematic side view of a jack-up platform comprising its legs as a pull-down support structure according to another embodiment of the invention; and finally

According to another embodiment of the invention, as shown in FIG. 12, a second floating barge 5-2 is connected to a jack-up platform 1-2 standing on its legs 12 through tension cables 46-2. The tension cables 46-2 extend from a lower position of the legs 12 towards corner parts of the second floating structure 5-2. The tension cables 46-2 are tensioned, for instance by winches (not shown) provided on the legs 12 of the jack-up platform 1-2 or otherwise and/or on the floating structure 5-2, which brings the second floating structure 5-2 from a floating draft to an increased mooring draft, as shown in FIG. 12. This effectively stabilizes the floating structure 5-2 with respect to horizontal and vertical motions. An additional push-down or pull-down support structure 4-2 may be present at a side of the jack-up platform 1-2. As also shown, a tug 9-1 is connected to the second floating structure 5-2 by a pulling wire 9-2, and is thrusted in the direction 9-3 to keep a relatively constant distance from the second floating structure 5-2 to the jack-up platform 1-2.

Figure 13:
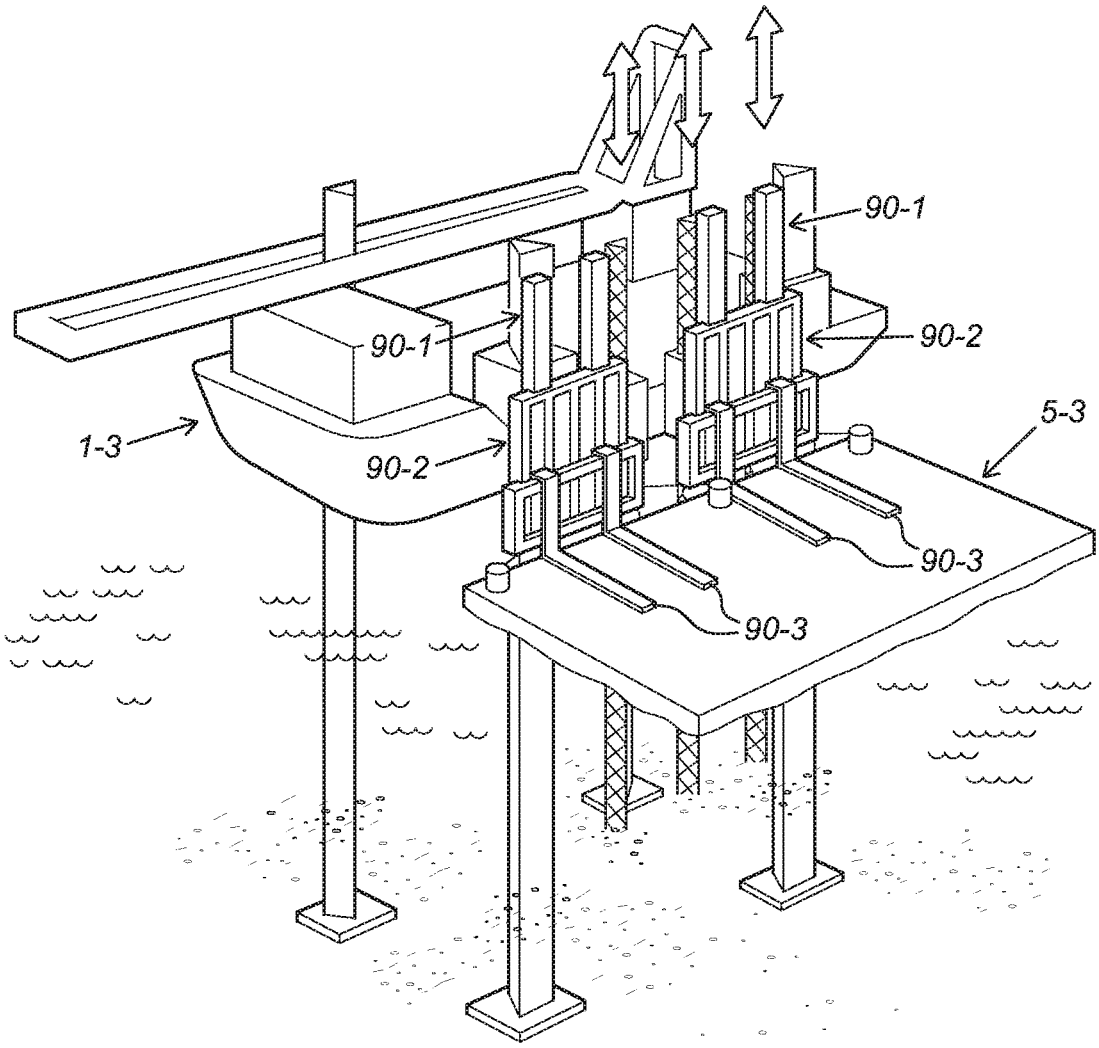
FIG. 13 represents a schematic perspective view of a jack-up platform provided with a push-down support structure according to yet another embodiment of the invention.

With reference to FIG. 13, yet anther embodiment is shown in which use is made of a push-down support structure 90 connected to a side of a jack-up platform 1-3. The mooring system in this embodiment is configured to push the second floating structure 5-3 down in the water from the floating draft to the larger mooring draft. To this end, the push-down support structure 90 is attached to the hull of the jack-up platform 1-3 through a steel leg structure 90-1, which may be embodied as the elongated support members 4-1 of FIG. 11, to which steel leg structure 90-1 is movably connected a guiding device 90-2 that may be moved up and down in a vertical direction. Each guiding device 90-2 carries pushing members 90-3 that are at least movable in the vertical direction and contact a top or deck surface of the second floating structure 5-3, as shown.

Some more specific examples of embodiments according to the invention will now be given.

Figure 1:
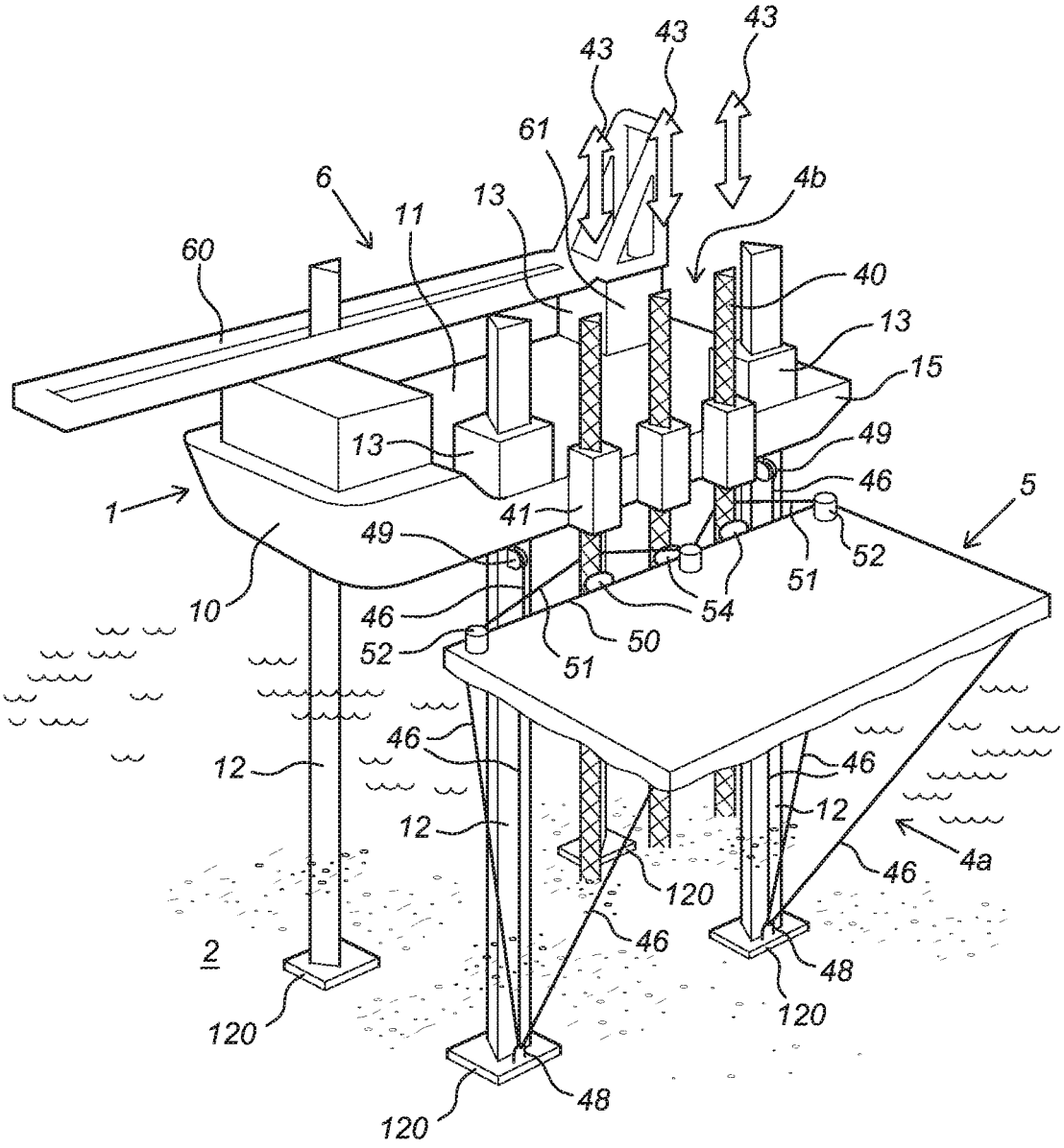
FIG. 1 represents a schematic perspective rear view of a jack-up platform against which a floating vessel is moored in accordance with an embodiment of the invention.
Figure 2:
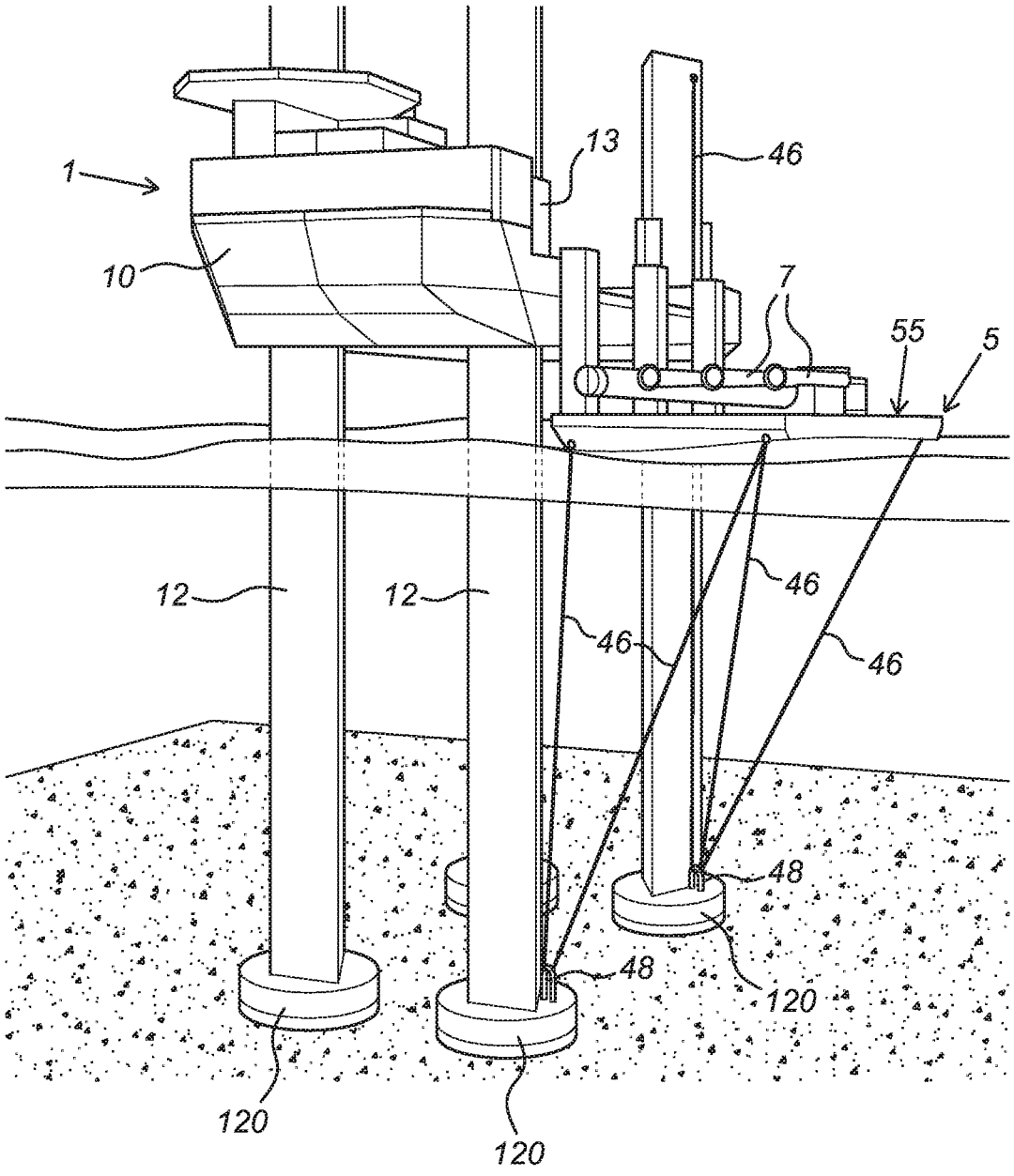
FIG. 2 represents a schematic perspective front view of the jack-up platform shown in the embodiment of FIG. 1.

With reference to FIG. 1, a jack-up vessel or platform 1 in accordance with an embodiment of the invention comprises a hull 10, a horizontal working deck 11 and a number of vertically extending legs 12 that connect to the working deck 11 through a jacking system 13, provided on corners of the hull 10. Each jacking system 13 is configured to move a leg 12 between a higher position, in which the leg 12 is free from an underwater bottom 2 and the hull 10 is floating on the water 3, and a lower position, shown in FIGS. 1 and 2. In the lower position of the legs 12, each leg 12 takes support on or in the underwater bottom 2 and the hull 10 is jacked out of the water over some distance between a bottom of the hull 10 and the water surface 30. The legs 12 shown are of lattice type and at a bottom side provided with shoes or spud cans 120. The legs 12 may be embodied differently however, and may for instance comprise solid legs, optionally without shoes 120.

The jack-up platform 1 further comprises a mooring system (4*a*, 4*b*). The mooring system (4*a*, 4*b*) is configured to moor a floating vessel 5 at a mooring side 15 of the jack-up platform 1. In the shown embodiment, the mooring system (4*a*, 4*b*) comprises means 4*a* for stabilizing the floating vessel 5 in a vertical and horizontal direction, and optional additional means 4*b* for stabilizing the floating vessel 5. The stabilizing means 4*a* comprise a number of tension cables 46 that extend between a leg 12 of the jack-up platform 1 in the jacked-up state and the floating vessel 5 to be moored. Each tension cable 46 is configured to pull the floating vessel 5 down in the water from a floating draft to a larger mooring draft by making use of said leg 12. In the embodiment shown in FIG. 1, the mooring position is along a side 15 of the jack-up platform 1 between two legs 12 positioned at that side 15, and the mooring system (4*a*, 4*b*) comprises a system of tension cables 46 for each of said legs 12.

As shown, the tension cables 46 extend between each leg 12 of the jack-up platform 1 and are attached to four corners of the floating vessel 5. The tension cables 46 in particular extend between the floating vessel 5 to be moored to a sheave 48 provided at a lower part of each leg 12 of the jack-up platform 1 and from there to a winch 49 provided at a higher part of the leg 12, or close to the leg 12 at a part of the hull 10 of the jack-up platform. Each winch 49 is configured to pull at each cable 46 to pull down the floating vessel 5 to a mooring draft. Each winch 46 may be positioned in any suitable position of the jack-up platform 1 or mooring system (4*a*, 4*b*).

Figure 3:
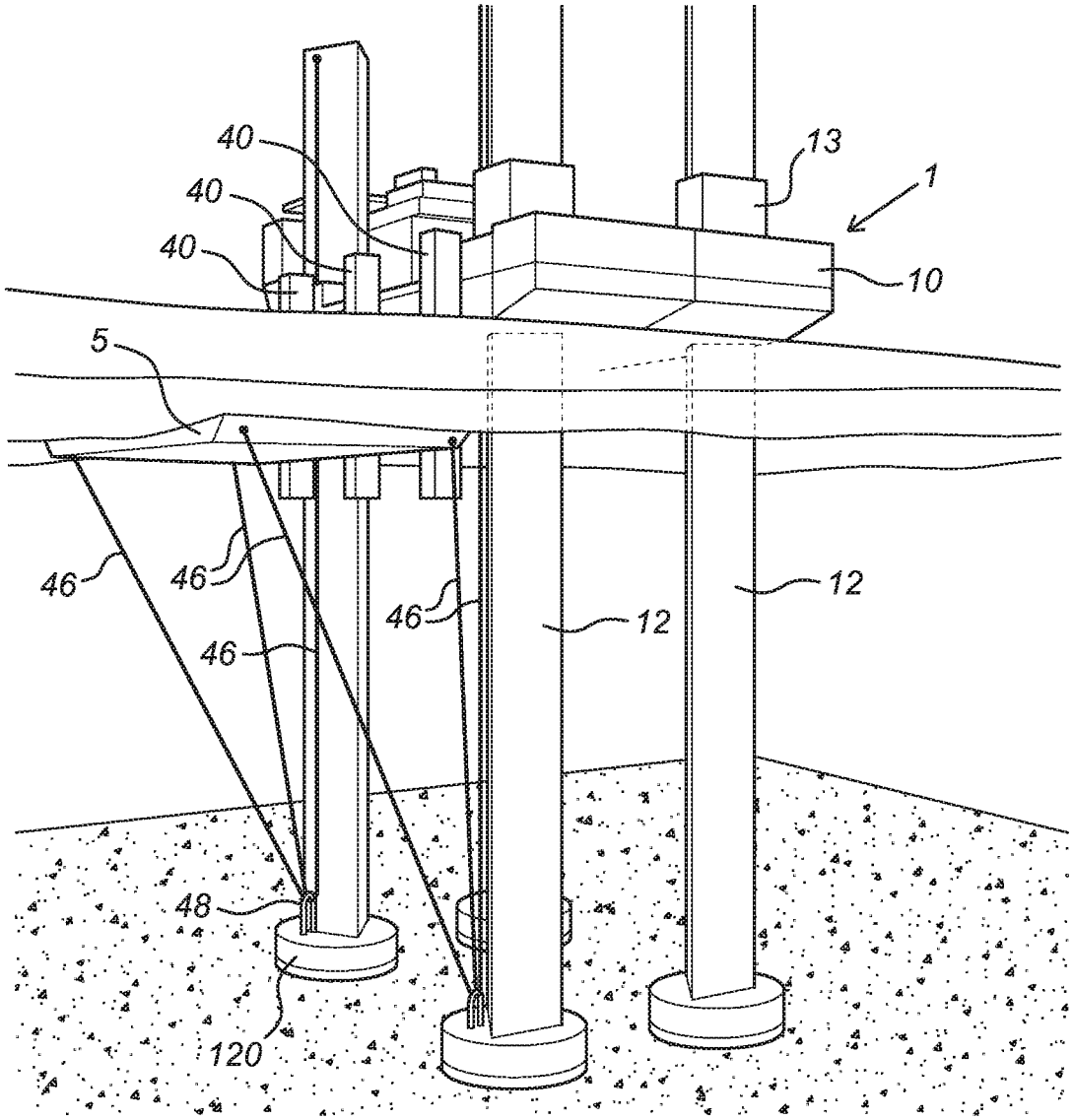
FIG. 3 represents a schematic side view of the jack-up platform shown in the embodiment of FIG. 1.

The mooring system (4*a*, 4*b*) further comprises means 4*b* for stabilizing the floating vessel 5 in an optional manner. These means 4*b* comprise in the embodiment shown in FIGS. 1-3, three elongated support members in the form of lattice or other elongated support members of triangular or other cross-section shape 40, and guiding means, which could come in the form of a jacking system 41, rigidly connected to the hull 10 of the jack-up platform 1 along a line extending parallel to the mooring side 15 of the hull 10. The connection may be welded, or may be embodied by any other suitable way of connection. Each guiding means 41 in operation holds an elongated support member 40 and is able to move the elongated support member 40 up and down between different vertical positions, as schematically shown by the arrows 43 in FIG. 1. Each guiding means 41 is configured to rigidly hold an elongated support member 40 in a support position, shown in FIGS. 1 and 2, in which each elongated support member 40 (or at least some of these legs 40) is within reach of a hull part 50 of the floating vessel 5 to be supported when the hull 10 is jacked out of the water 3 over the distance and the jack-up platform 1 rests on its legs 12. In the support position, each elongated support member 40 is jacked down sufficiently to be able to support said hull part 50 of the floating vessel 5, moored against the jack-up platform 1. In the support position, each elongated support member 40 thereto extends into the water 3 over a distance (see FIG. 2) that reaches sufficiently deep to enable supporting the hull part 50 of the floating vessel 5 in mooring position. An outer end of each elongated support member 40 is hanging freely in the water 3.

In the mooring position of the floating vessel 5, the connection between the floating vessel or barge 5 and the elongated support members 40 may be accomplished by using conventional mooring lines 51 and winches 52, provided on the floating vessel 5. The winches could also be provided on the jack-up vessel 1, or be integrated in one or more of the elongated support members 40. The winches 52 are configured to take in a length of mooring line 51, thereby bringing the vessel 5 closer to the elongated support members 40 as shown in FIG. 1, until the hull part 50 contacts the elongated support members 40. Paying out a length of mooring line 51 may remove the floating vessel 5 from the mooring side 15 of the jack-up platform. To prevent peak loads on the elongated support members 40 from occurring, shock dampers may be incorporated in between each elongated support member 40 and the hull part 50 of the floating vessel 5, such as the fenders 54.

The jack-up platform 1 may further comprise a lifting device 6, a boom 60 of which is pivotably provided around a lifting device base 61, supported on the working deck 11 of the jack-up platform 1.

In another embodiment, the guiding means 41 are provided with an optional hinge point on the side of the hull 10, and the elongated support members 40 positioned on deck separately from the guiding means 41. The elongated support members 40 may then be taken up by the lifting device 6 and inserted in the guiding means 41, and brought overboard.

Figure 4:
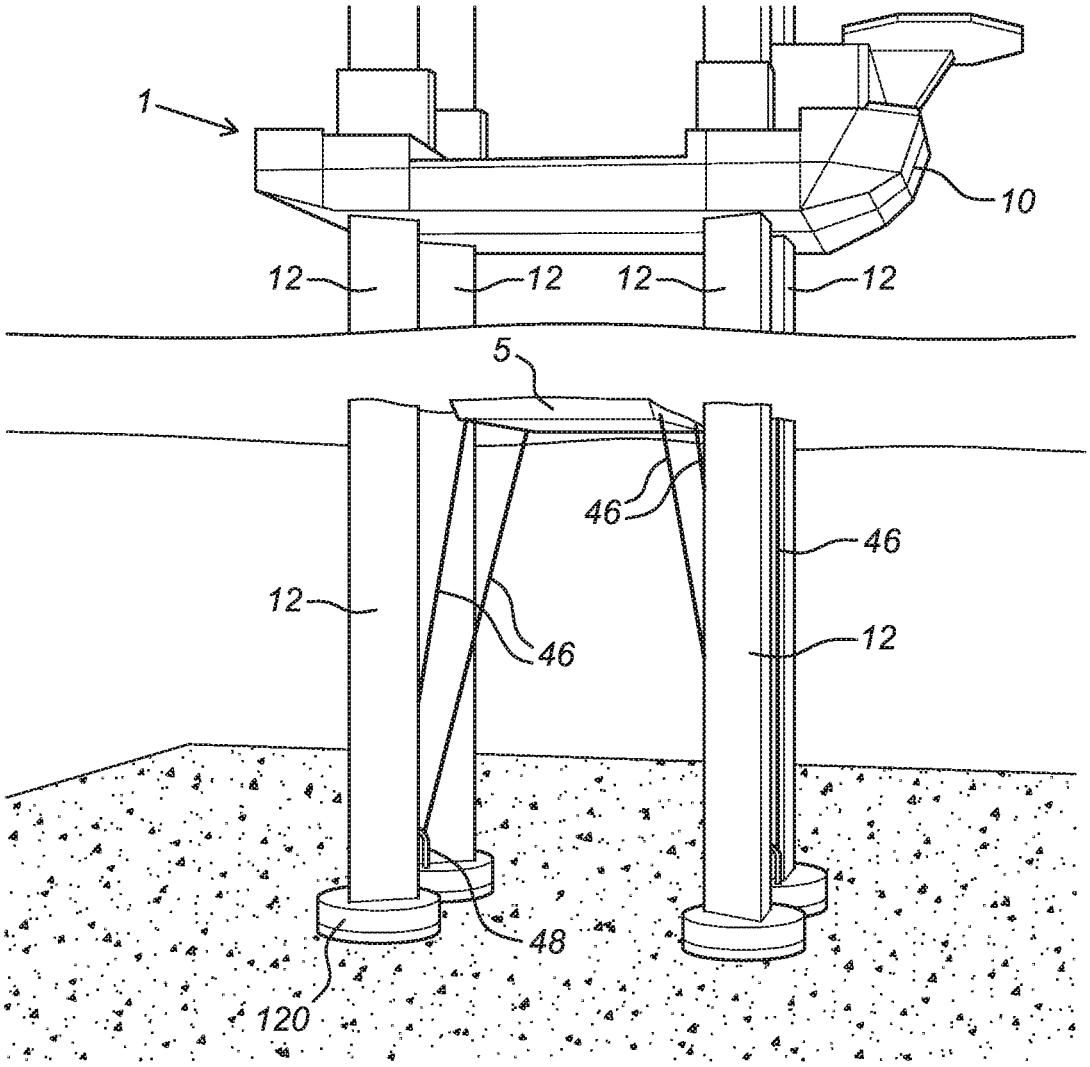
FIG. 4 represents a schematic perspective view of a jack-up platform underneath which a floating vessel is moored in accordance with yet another embodiment of the invention.

In the embodiment shown in FIG. 4, the mooring position of the floating vessel 5 is underneath the jack-up platform 1 in jacked-up state. In this embodiment, the means 4*b* for stabilizing the floating vessel 5 may be omitted. This function is indeed taken over by the tension cables 46 that extend between all legs 12 of the jack-up platform 1 and the floating vessel 5, in particular its four corners. The floating vessel 5 in this embodiment is positioned about centrally between the legs 12 of the jack-up platform 1, although this may also be a off-center position, if desired.

Figure 5:
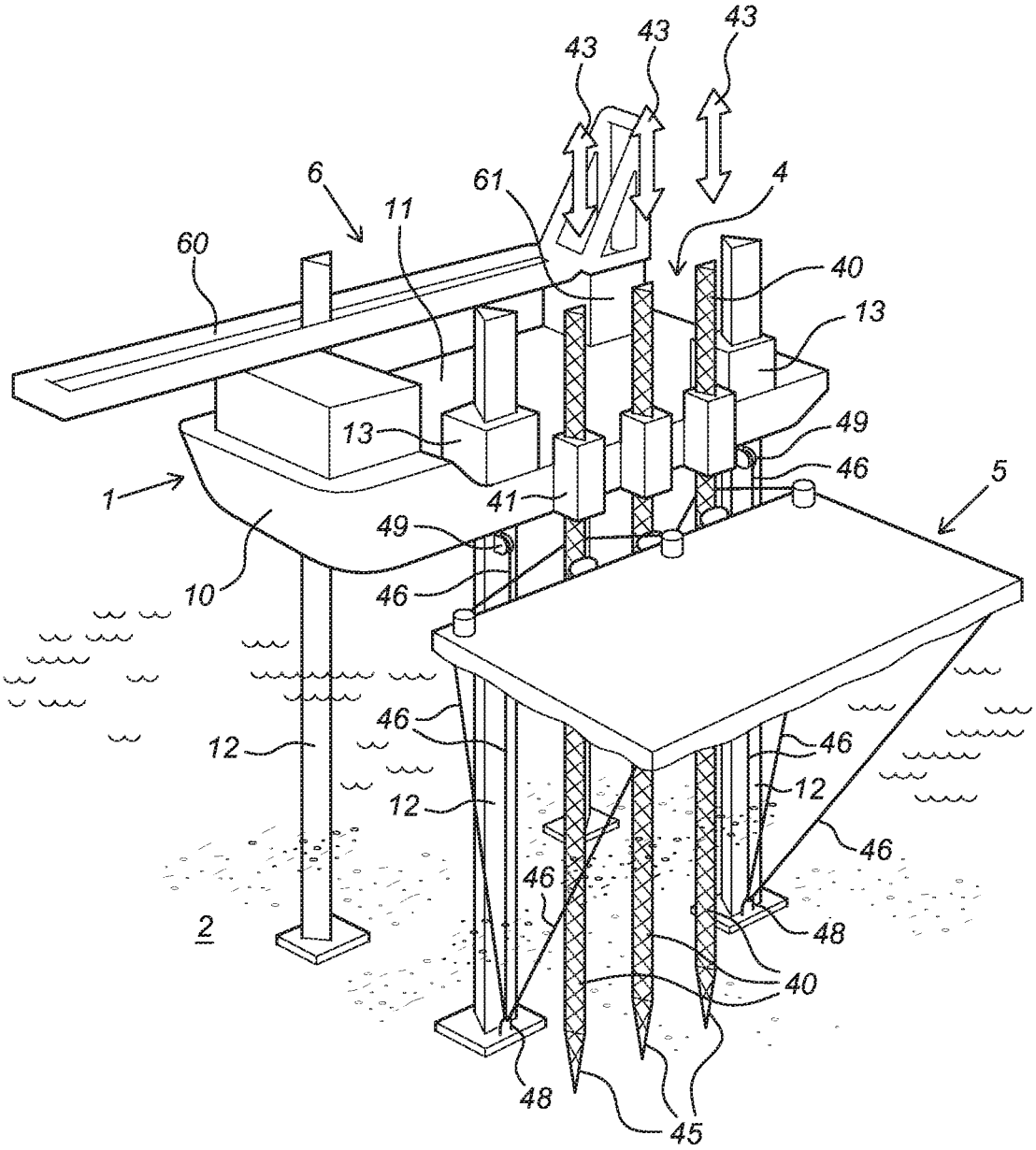
FIG. 5 represents a schematic perspective view of yet another embodiment of the jack-up platform.

FIG. 5 shows yet another embodiment of the invention. Here, a jack-up platform is provided having the same features as the embodiment shown in FIGS. 1-3, but having the three elongated support members 40, in the support position, extend into the underwater bottom 2 over some distance to take support in the underwater bottom 2. In this embodiment, forces exerted by the moored vessel 5 on the elongated support members 40 are not only absorbed by the guiding means 41 and led into the hull 10 of the jack-up platform 1, but are also absorbed by their fixation into the underwater bottom 2. In order to facilitate penetration of the elongated support members 40 into the underwater bottom 2, the elongated support members 40 may at a bottom side thereof be provided with pointed end parts 45.

Figure 6:
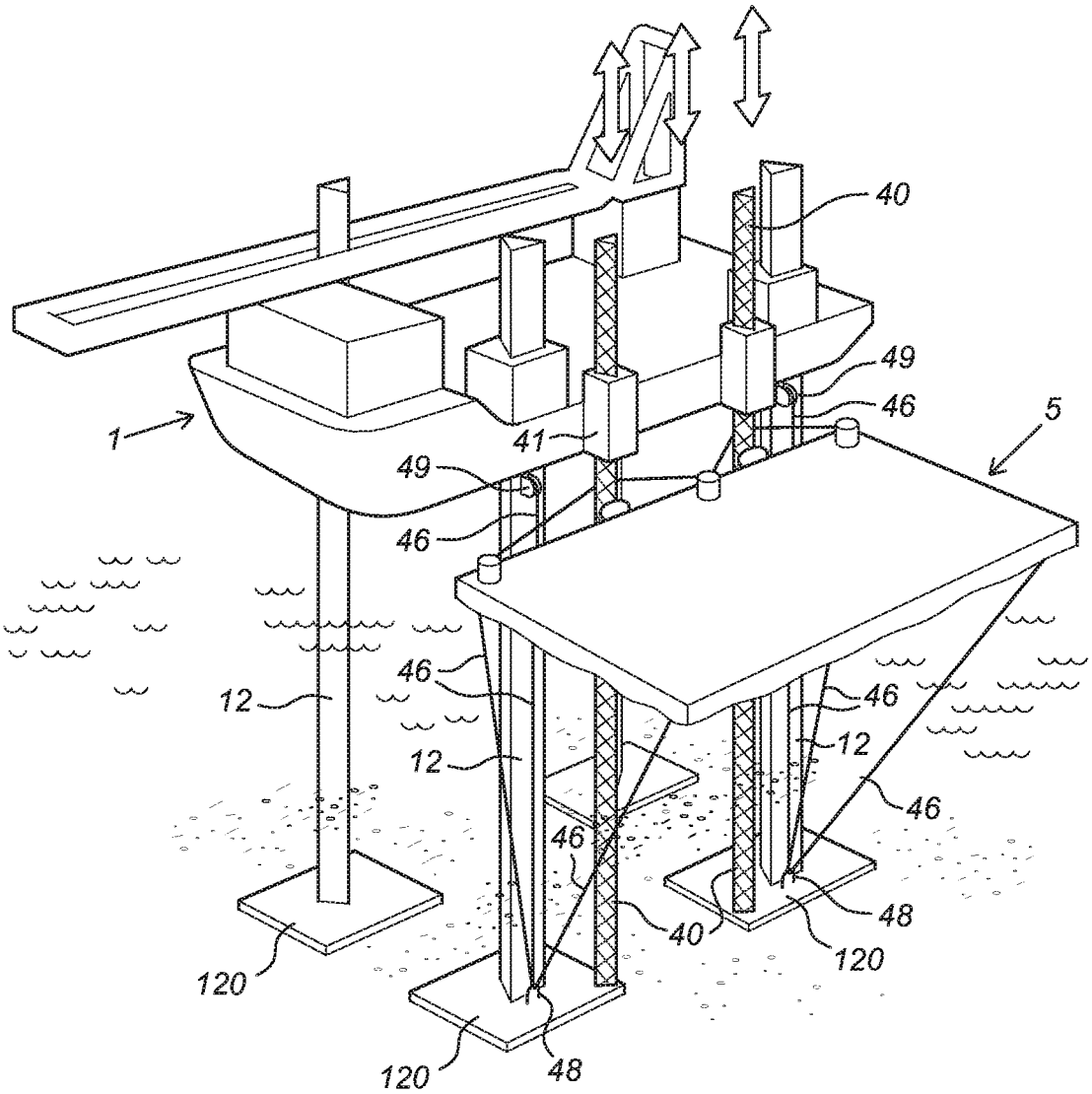
FIG. 6 represents a schematic perspective view of a jack-up platform against which a floating vessel is moored in accordance with yet another embodiment of the invention.
Figure 7:
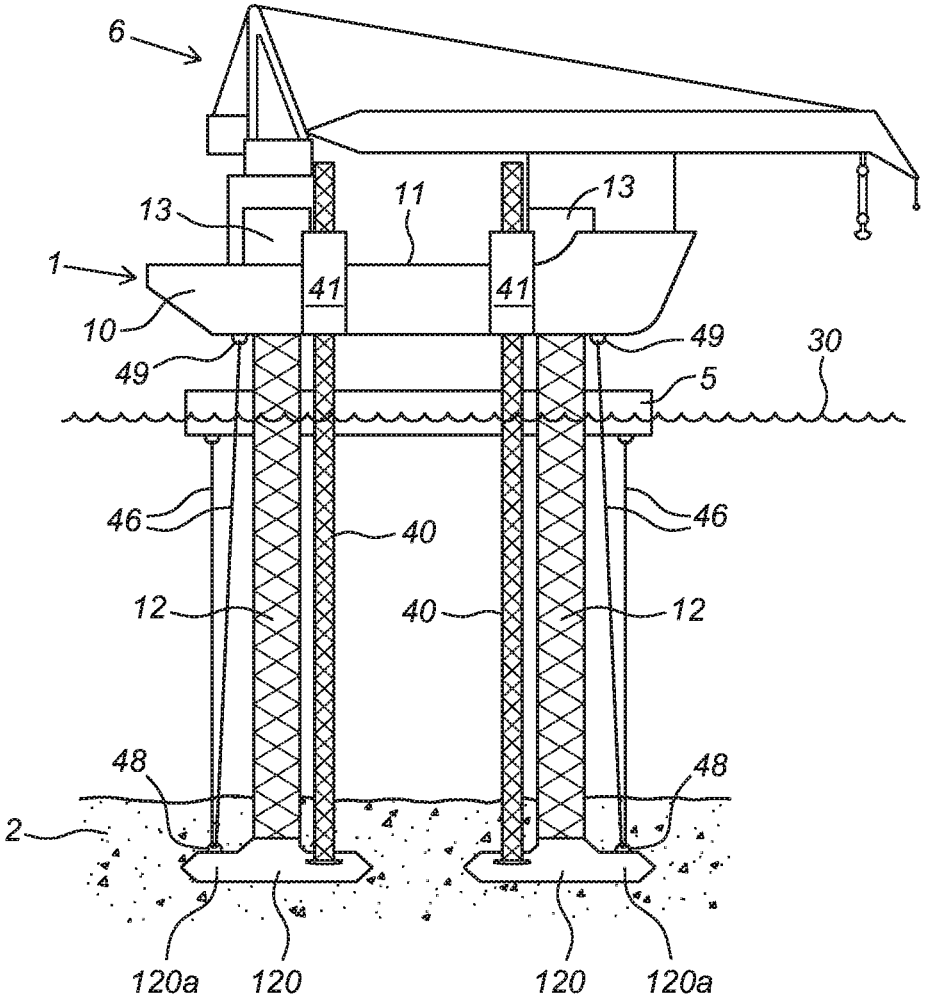
FIG. 7 represents a schematic side view of the jack-up platform shown in the embodiment of FIG. 6.

Yet another embodiment of the invention is shown in FIGS. 6 and 7. Here, a jack-up platform is provided having the same features as the embodiment shown in FIGS. 1-3, but having the three elongated support members 40, in the support position, extend into an enlarged foot section or shoe 120 of each vertical leg 12 of the jack-up vessel or platform 1. In the support position of the elongated support members 40, each elongated support member 40 at the mooring side 15 of the jack-up vessel or platform 1 then takes support in its corresponding spud leg shoe 120, provided on the mooring side 15. In this embodiment, forces exerted by the moored vessel 5 on the tension cables 46 and the elongated support members 40 are not only absorbed by the legs 12 and the guiding means 41 and led into the hull 10 of the jack-up platform 1, but are also absorbed by their fixation into the shoes 120. The connection between a lower part of the elongated support members 40 and the shoes 120 may be permanent, for instance by welding, or may be detachable, for instance by providing the shoes 120 with holes into which a lower part of each elongated support member 40 may be received and, optionally, secured. This embodiment has the additional advantage of not having to rely on the, sometimes uncertain or variable, properties and cohesion of the underwater bottom 2.

As shown in the embodiment of FIGS. 6 and 7, the jack-up platform 1 may have legs 12, a lower part of which may comprise a transversely enlarged foot support 120, provided with enlargements 120*a*. This allows orienting the tension cables 46 about vertically, which may be optimal from a force transmission point of view.

Figure 8:
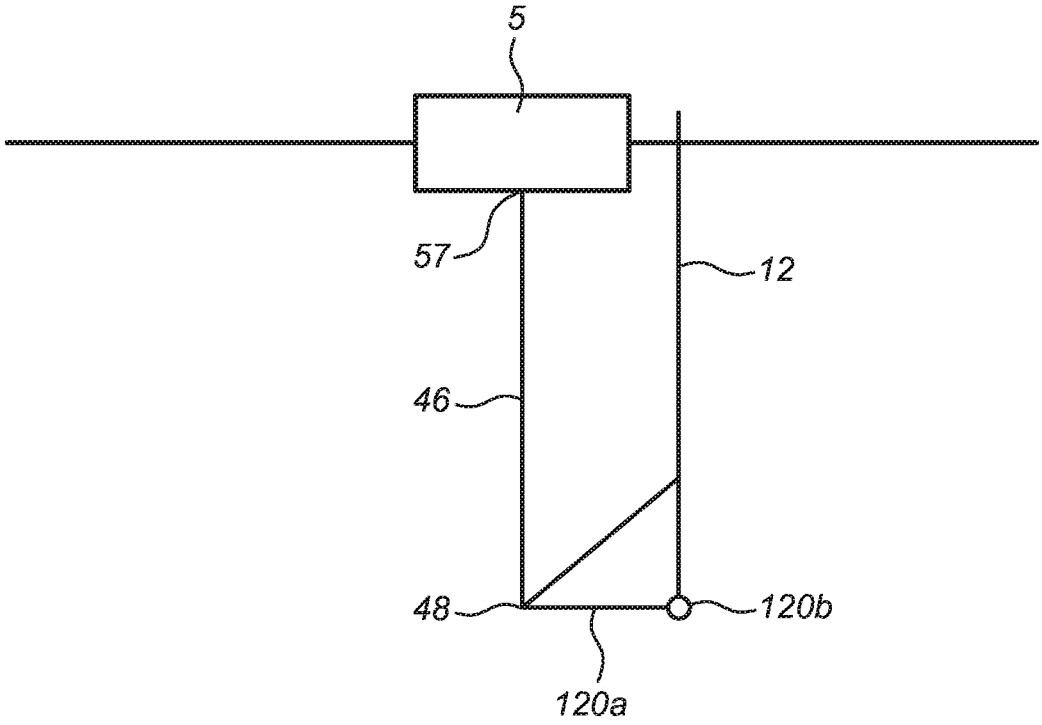
FIG. 8 represents a schematic side view of an embodiment of the jack-up platform showing foldable enlarged feet of the legs.

As schematically shown in FIG. 8, the transversely enlarged foot support 120 may comprise extendable parts 120*a* in the transverse direction, wherein the extendable parts 120*a* may be foldable around a hinge 120*b* from an inward position to a folded out position, shown in FIG. 8. The extension is preferably provided with the sheave 48, such that the tension cable 46 may be oriented about vertically between the extension 120*a* and its attachment point 57 on the floating vessel 5.

Figure 9:
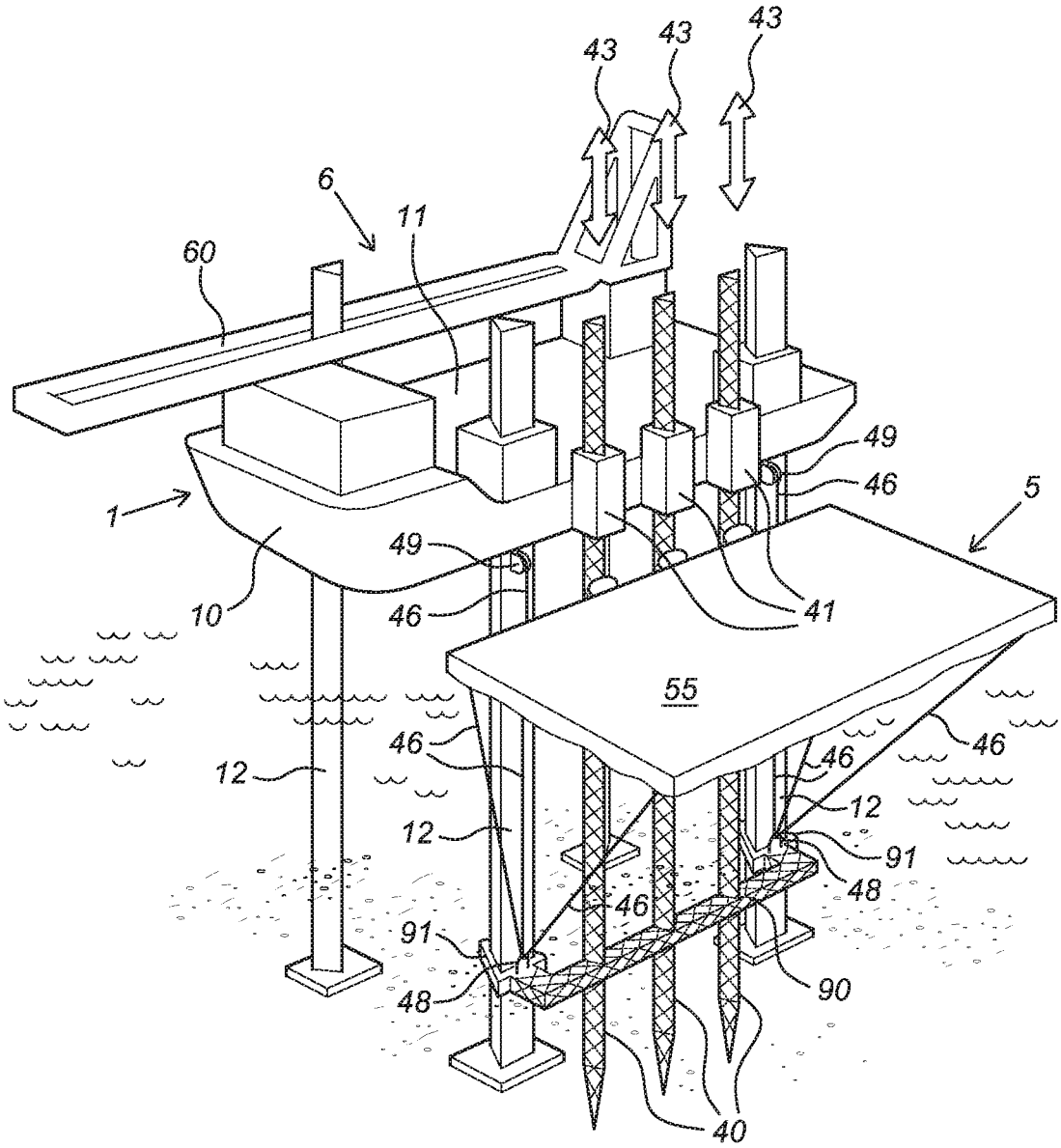
FIG. 9 represents a schematic perspective view of a jack-up platform against which a floating vessel is moored in accordance with yet another embodiment of the invention.

FIG. 9 yet shows another embodiment of the jack-up platform 1 and mooring system 4. In the embodiment shown, the jack-up platform 1 further comprises a connecting structure, comprising a steel brace or beam 90, that is configured to connect the elongated support members 40 with a vertical spud leg 12 of the jack-up platform 1. The sheaves 48 are in this embodiment connected to the structure. The connecting structure connects with each spud leg 12 through guides 91 that are provided on each end of the brace or beam 90. The guides 91 allow the elongated support members 40 to be moved between different vertical positions, relative to the spud legs 12 of the jack-up platform 1. In this embodiment, forces exerted by the moored vessel 5 on the elongated support members 40 are not only absorbed by the guiding means 41 and led into the hull 10 of the jack-up platform 1, but are also absorbed by the spud legs 12 on the mooring side 15, or alternatively, on spud legs provided on another side than the mooring side 15. The forces are transmitted to said spud legs 12 through the connecting structure. The connecting structure shown has one brace 90 but may also comprise a plurality of braces, provided on different heights (vertical levels).

Figure 10:
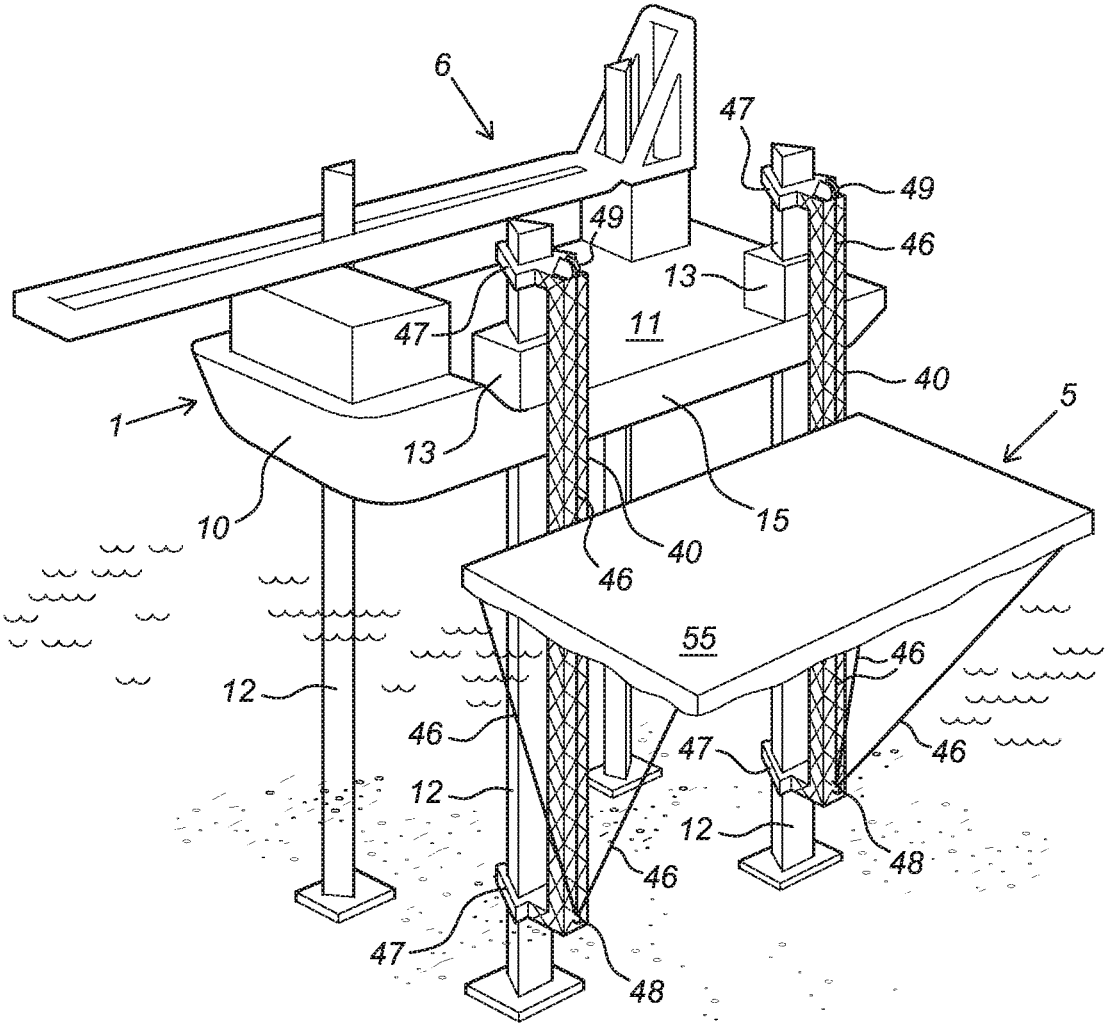
FIG. 10 represents a schematic perspective view of a jack-up platform against which a floating vessel is moored in accordance with yet another embodiment of the invention.

As shown in FIG. 10, another embodiment comprises a jack-up platform 1 wherein the guiding means actually comprise the vertical spud legs 12 provided at the mooring side 15 of the jack-up platform 1, and its corresponding jacking system 13. The elongated elongated support members 40 in this embodiment extend vertically along the mooring side spud legs 12 in the support position. They are attached to the mooring side spud legs 12 through elongated support member guides 47 that are fixedly provided on each end of each elongated support member 40. The sheaves 48 and winches 49 are in this embodiment connected to the elongated support members 40. An upper and a lower elongated support member gliding guide 47 of a elongated support member 40 are provided around a spud leg 12 such that they allow the elongated support member 40 to be moved between different vertical positions, relative to the spud leg 12 of the jack-up platform 1. At least an upper or a lower elongated support member guide 47 (or both) may be fixed onto the leg 12 in the support position of the elongated support member 40. In this embodiment, forces exerted by the moored vessel 5 on the elongated support members 40 are not absorbed by the guiding means 41 and led into the hull 10 of the jack-up platform 1. Instead, they are absorbed by the jacking system 13 of the spud legs 12 at the mooring side 15. This may be a practical solution, as long as the expected mooring forces do not increase to levels such that the integrity of the spud legs 12 system may be compromised.

The invented jack-up platform 1 may be used advantageously for mooring a floating vessel 5 against it. An assembly of the invented jack-up platform 1 and such a floating vessel 5 represents a relatively stable assembly, due to the stabilizing effect of the spud legs 12 and the mooring system (4*a*, 4*b*) on the assembly (1, 5).

The assembly (1, 5) of a floating vessel 5 moored against a jack-up platform 1 under the intervention of the mooring system (4*a*, 4*b*), allows to safely lift an object, such as a wind turbine blade 7 (see FIG. 2) from the deck 55 of the moored floating vessel 5. Other systems may in addition be used to safely lift-off an object. Another benefit of the invented mooring system is that the floating vessel is kept positioned in the horizontal direction as close as possible to the jack-up platform 1 and its lifting device to maximize the lifting device's efficiency. Having the invented mooring system on the lifting device vessel means it can be used with all different kinds of floating vessels without being forced to adapt the latter. The lifted object may be provided on the working deck 11 of the jack-up platform 1 or on another substrate, such as a foundation element of a wind turbine (not shown) provided in the underwater bottom 2. It is without saying that other objects may be lifted such as a monopile, a transition piece, wind turbine components and other objects that are used in installing wind turbines offshore.

The assembly (1,5) may further be used to safely transfer cargo, goods and personnel from the floating vessel 5 to the jack-up platform 1, and vice versa.

The invention is not limited to the above described embodiments and also comprises modifications thereof, to the extent that these fall within the scope of the claims appended below.

The invention claimed is:

1. A floatable structure that is floating on water of jacked-up out of the water, comprising a hull provided with a deck and a mooring system attached to the floatable structure and configured to moor a second floating structure at a mooring position relative to the floatable structure, wherein the mooring system is configured to bring the second floating structure down in the water from an initial floating draft to a larger mooring draft to reduce motions of the second floating structure relative to the floatable structure, wherein the mooring system is configured to pull the second floating structure down in the water from the floating draft to the larger mooring draft and thereto comprises a pull-down support structure attached to the hull of the floatable structure and extending over some length into the water to a depth below the second floating structure, and at least one tension cable extending between the pull-down support structure and the second floating structure to be moored.

2. The floatable structure according to claim 1, wherein the mooring system configured to pull the second floating structure down comprises said at least one tension cable extending between the pull-down support structure and corners of the second floating structure to be moored.

3. The floatable structure according to claim 1, wherein the mooring position is underneath the floatable structure.

4. The floatable structure according to claim 1, wherein the mooring position is along a side of the floatable structure.

5. The floatable structure according to claim 1, wherein the mooring system comprises the pull-down support structure and the at least one tension cable extends between the second floating structure to be moored to a sheave provided at a lower part of the pull-down support structure and from there to a winch provided at a higher part of the pull-down support structure.

6. The floatable structure according to claim 5, wherein the higher part of the pull-down support structure is above the water line.

7. The floatable structure according to claim 1, wherein the mooring system comprises the pull-down support structure and the support structure is formed by at least one elongated support member attached to a side of the floatable structure and extending over some length into the water to a depth below the second floating structure, wherein the at least one elongated support member preferably extends vertically, and the number of elongated support members is at least two, and more preferably at least three.

8. The floatable structure according to claim 7, further comprising guiding means connected to the hull of the floatable, and configured to rigidly hold an elongated support member in a support position.

9. The floatable structure according to claim 8, wherein the guiding means are hingedly connected to the hull of the floatable structure.

10. The floatable structure according to claim 8, wherein the guiding means are configured to hold the elongated support member and move the same between different vertical positions, preferably by comprising a jacking system.

11. The floatable structure according to claim 7, wherein the at least one elongated support member takes support on or in an underwater bottom.

12. The floatable structure according to claim 1, wherein the floatable structure comprises a jack-up platform comprising a number of vertical legs that connect to a working deck through jacking systems, each jacking system being configured to move a leg between a lower position, in which the leg takes support on an underwater bottom and the hull is jacked-up out of the water, and a higher position, in which the leg is free from the underwater bottom and the hull is floating on the water, wherein the mooring system comprises one leggy of the jack-up platform.

13. The floatable structure according to claim 12, wherein the mooring system comprises the support structure and said support structure is formed by one or more legs of the jack-up platform.

14. The floatable structure according to claim 12, wherein the legs of the jack-up platform are in the lower position.

15. The floatable structure according to claim 12, wherein the mooring position is along a side of the jack-up platform between two legs, and the mooring system comprises a tension cable for each of said legs.

16. The floatable structure according to claim 12, wherein the lower part of the leg comprises a transversely enlarged foot support of the leg.

17. The floatable structure according to claim 16, wherein the transversely enlarged foot support is extendable in the transverse direction, which extension is provided with the sheave.

18. The floatable structure according to claim 12, wherein the higher part of the leg is below the jacking system of the leg and optionally above the water line.

19. A method for mooring a second floating structure at a mooring position relative to a floatable structure in accordance with claim 1, the method comprising: bringing the second floating structure down in the water with the mooring system of the floatable structure from an initial floating draft to a larger mooring draft to reduce motions of the second floating structure relative to the floatable structure, wherein the mooring system pulls the second floating structure down in the water from the floating draft to the larger mooring draft.

20. The method according to claim 19, wherein the mooring system pulls the second floating structure down by tensioning at least one tension cable that extends between a pull-down support structure extending over some length into the water to a depth below the second floating structure and attached to the hull of the floatable structure, and the second floating structure to be moored.

21. The method according to claim 19, wherein the floatable structure comprises a jack-up platform, the method comprising the steps of:

moving the legs of the jack-up platform from a higher position, in which the legs are free from an underwater bottom and the hull is floating on the water, to a lower position, in which the legs take support on the underwater bottom and the hull is jacked-up out of the water;

providing at least one tension cable that extends between a leg of the jack-up platform in the jacked-up state and the second floating structure to be moored, and pulling the second floating structure down in the water from a floating draft to a larger mooring draft by making use of said leg; and mooring the second floating structure against the jack-up platform.

22. The method according to claim 19, wherein the mooring system comprises the pull-down support structure and the support structure is formed by the at least one elongated support member attached to the side of the floatable structure, the method further comprising providing at least one tension cable that extends between the at least one elongated support member and the second floating structure to be moored, and pulling the second floating structure down in the water from a floating draft to a larger mooring draft by making use of said support member; and mooring the second floating structure against the at least one elongated support member.

23. The floatable structure according to claim 1, wherein the floatable structure comprises a jack-up platform comprising a number of vertical legs that connect to a working deck through jacking systems, each jacking system being configured to move a leg between a lower position, in which the leg takes support on an underwater bottom and the hull is jacked-up out of the water, and a higher position, in which the leg is free from the underwater bottom and the hull is floating on the water, wherein the mooring system comprises two legs of the jack-up platform.

* * * * *